US012187396B2

(12) United States Patent
Kadobayashi

(10) Patent No.: US 12,187,396 B2
(45) **Date of Patent: *Jan. 7, 2025**

(54) VESSEL OPERATION SYSTEM AND VESSEL

(71) Applicant: YAMAHA HATSUDOKI KABUSHIKI KAISHA, Iwata (JP)

(72) Inventor: Yoshiyuki Kadobayashi, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 487 days.

This patent is subject to a terminal disclaimer.

(21) Appl. No.: 17/495,847

(22) Filed: Oct. 7, 2021

(65) Prior Publication Data

US 2022/0126963 A1 Apr. 28, 2022

(30) Foreign Application Priority Data

Oct. 22, 2020 (JP) ..... 2020-177388

(51) Int. Cl.
*B63H 20/08* (2006.01)
*B63H 20/00* (2006.01)
*B63H 20/02* (2006.01)

(52) U.S. Cl.
CPC ..... *B63H 20/08* (2013.01); *B63H 20/007* (2013.01); *B63H 20/02* (2013.01)

(58) Field of Classification Search
CPC ..... B63H 20/02; B63H 20/007; B63H 20/08; B63H 20/12; B63H 21/17; B63H 21/21
USPC ..... 440/1, 84
See application file for complete search history.

(56) References Cited

U.S. PATENT DOCUMENTS

| | | | | |
|---|---|---|---|---|
| 5,797,339 | A | 8/1998 | Moore et al. | |
| 9,988,134 | B1 * | 6/2018 | Gable | B63B 79/40 |
| 10,739,771 | B2 * | 8/2020 | Miller | G05D 1/0206 |
| 2016/0090166 | A1 | 3/2016 | Suzuki et al. | |
| 2020/0255103 | A1 | 8/2020 | Yamamoto et al. | |

FOREIGN PATENT DOCUMENTS

| | | | |
|---|---|---|---|
| JP | 10-175598 | A | 6/1998 |
| JP | 2008-110749 | A | 5/2008 |
| JP | 2016-068610 | A | 5/2016 |
| JP | 2017-132442 | A | 8/2017 |

OTHER PUBLICATIONS

Official Communication issued in corresponding European Patent Application No. 21202449.1, mailed on Mar. 29, 2022.

* cited by examiner

*Primary Examiner* — Daniel V Venne
(74) *Attorney, Agent, or Firm* — Keating & Bennett, LLP

(57) ABSTRACT

A vessel operation system includes an outboard motor or other propulsion apparatus disposed on a hull, a trolling motor mounted externally to the hull, a joystick or other first operator, and a controller. The joystick is operated by a vessel operator in order to indicate at least one of a magnitude and a direction of a thrust that the outboard motor is to apply to the hull. In a state in which the trolling motor is generating a first thrust, the controller controls the outboard motor so as to generate a second thrust in accordance with a command indicated by the joystick. Additionally, the controller controls the trolling motor so that the first thrust changes.

11 Claims, 6 Drawing Sheets

VESSEL OPERATION SYSTEM AND VESSEL

CROSS REFERENCE TO RELATED APPLICATIONS

This application claims the benefit of priority to Japanese Patent Application No. 2020-177388 filed on Oct. 22, 2020. The entire contents of this application are hereby incorporated herein by reference.

BACKGROUND OF THE INVENTION

1. Field of the Invention

The present invention relates to a vessel operation system, and to a vessel that includes the vessel operation system.

2. Description of the Related Art

Japanese Patent Application Publication No. 10-175598 discloses a boat that is provided with a main propulsion motor and a trolling motor. A vessel operator of the boat performs remote control of the main propulsion motor and the trolling motor by using an optical transmitter at a position in the boat that is remote from the main propulsion motor and the trolling motor.

Although with the boat of Japanese Patent Application Publication No. 10-175598, the vessel operator is enabled to perform remote control of both the main propulsion motor and the trolling motor by the optical transmitter, operations become complicated when it is desired to use a thrust of the main propulsion motor in a situation where the trolling motor is being used. More specifically, the vessel operator must perform an operation of stopping the trolling motor and thereafter perform an operation for generating the thrust from the main propulsion motor. If the trolling motor is not stopped, influence of a thrust of the trolling motor will be received when the main propulsion motor is actuated and therefore, finely tuned operation will be required of the vessel operator. It may be possible, instead of stopping the trolling motor, to adjust a magnitude or a direction of its thrust and use the thrust of the main propulsion motor together with using the thrust of the trolling motor. However, finely tuned operation will be required even in this case because an operation of adjusting the thrust of the trolling motor must be performed at the same time as performing an operation of adjusting the thrust of the main propulsion motor. Moreover, to obtain a desired hull behavior using the thrusts of both the main propulsion motor and the trolling motor, considerable vessel operation skill is required and expertise is demanded of the vessel operator.

Additionally, although not specifically mentioned in Japanese Patent Application Publication No. 10-175598, the thrust generated by the trolling motor is generally smaller than the thrust generated by the main propulsion motor. Therefore, if, for example, it is desired to quickly start the vessel that is stopped or is at low speed by the thrust generated by the trolling motor, the vessel operator will be likely to attempt driving the main propulsion motor in priority over the trolling motor. If in this case, not just driving of the main propulsion motor but driving of the trolling motor is also taken into consideration, it can be anticipated to realize an improvement for bringing a behavior of the boat closer to the vessel operator's intention.

SUMMARY OF THE INVENTION

In order to overcome the previously unrecognized and unsolved challenges described above, preferred embodiments of the present invention provide vessel operation systems that each include a propulsion apparatus disposed on a hull, a trolling motor mounted externally to the hull, a first operator, and a controller. The first operator is operated by a vessel operator in order to indicate at least one of a magnitude and a direction of a thrust that the propulsion apparatus should apply to the hull. In a state in which the trolling motor is generating a first thrust, the controller is configured or programmed to control the propulsion apparatus so as to generate a second thrust in accordance with a command indicated by the first operator. Additionally, the controller is configured or programmed to control the trolling motor so that the first thrust changes.

According to this structural arrangement, in a state in which a hull behavior is achieved by the first thrust of the trolling motor, the vessel operator who desires to achieve a hull behavior mainly by the thrust of the propulsion apparatus should operate the first operator. When the vessel operator operates the first operator, the propulsion apparatus generates the second thrust and the first thrust of the trolling motor changes. When the first operator is thus operated, the propulsion apparatus and the trolling motor are controlled integrally in response to its command and, therefore, a vessel operation skill demanding expertise so as to adjust the first thrust of the trolling motor and the second thrust of the propulsion apparatus individually is not required of the vessel operator. And if an influence that the first thrust has on a hull behavior decreases in accordance with the change of the first thrust, a hull behavior will automatically be achieved mainly by the second thrust and, therefore, the vessel operator is able to perform a vessel operation that does not require finely tuned operation.

In a preferred embodiment of the present invention, in a state in which the trolling motor is generating the first thrust, the controller is configured or programmed to control the propulsion apparatus so as to generate the second thrust in accordance with the command indicated by the first operator. Additionally, the controller is configured or programmed to control the trolling motor so that a magnitude of the first thrust differs from a magnitude of the second thrust.

According to this structural arrangement, in a state in which a hull behavior is achieved by the first thrust of the trolling motor, the vessel operator who desires to achieve a hull behavior mainly by the thrust of the propulsion apparatus should operate the first operator. When the vessel operator operates the first operator, the propulsion apparatus generates the second thrust and the magnitude of the first thrust of the trolling motor changes so as to differ from the magnitude of the second thrust. If the influence that the first thrust has on a hull behavior decreases in accordance with the change in the magnitude of the first thrust, a hull behavior will automatically be achieved mainly by the second thrust and, therefore, the vessel operator is able to perform a vessel operation that does not require finely tuned operation.

In a preferred embodiment of the present invention, in a state in which the trolling motor is generating the first thrust, the controller is configured or programmed to control the propulsion apparatus so as to generate the second thrust in accordance with the command indicated by the first operator. Additionally, the controller is configured or programmed to control the trolling motor so that a direction of the first thrust differs from a direction of the second thrust.

According to this structural arrangement, in a state in which a hull behavior is achieved by the first thrust of the trolling motor, the vessel operator who desires to achieve a hull behavior mainly by the thrust of the propulsion apparatus should operate the first operator. When the vessel operator operates the first operator, the propulsion apparatus generates the second thrust and the direction of the first thrust of the trolling motor changes so as to differ from the direction of the second thrust. If the influence that the first thrust has on a hull behavior decreases in accordance with the change in the direction of the first thrust, a hull behavior will automatically be achieved mainly by the second thrust and, therefore, the vessel operator is able to perform a vessel operation that does not require finely tuned operation.

In a preferred embodiment of the present invention, in a state in which the trolling motor is generating the first thrust, the controller is configured or programmed to control the trolling motor so that the first thrust decreases in accordance with the command indicated by the first operator.

According to this structural arrangement, when the vessel operator who desires to change a hull behavior from being achieved by the first thrust of the trolling motor to being achieved mainly by the thrust of the propulsion apparatus operates the first operator, the propulsion apparatus generates the second thrust and the first thrust decreases. The influence that the first thrust has on a hull behavior decreases in accordance with the decrease in the first thrust. Thus, a hull behavior is automatically achieved mainly by the second thrust and, therefore, the vessel operator is able to perform a vessel operation that does not require finely tuned operation.

In a preferred embodiment of the present invention, in a state in which the trolling motor is generating the first thrust, the controller is configured or programmed to stop the trolling motor in accordance with the command indicated by the first operator.

According to this structural arrangement, when the vessel operator who desires to change a hull behavior from being achieved by the first thrust of the trolling motor to being achieved mainly by the thrust of the propulsion apparatus operates the first operator, the propulsion apparatus generates the second thrust and the trolling motor stops. The first thrust becomes zero in accordance with the stoppage of the trolling motor and, therefore, the influence that the first thrust has on a hull behavior disappears. Thus, a hull behavior is automatically achieved by the second thrust and, therefore, the vessel operator is able to perform a vessel operation that does not require finely tuned operation.

In a preferred embodiment of the present invention, the controller controls the propulsion apparatus so as to generate the second thrust in accordance with the command indicated by the first operator. Additionally, the controller is configured or programmed to control the trolling motor so that the first thrust becomes a thrust that hastens a behavior of the hull by the second thrust.

According to this structural arrangement, the vessel operator who desires to change a hull behavior from being achieved by the first thrust of the trolling motor to being achieved mainly by the thrust of the propulsion apparatus should operate the first operator. When the vessel operator operates the first operator, the propulsion apparatus generates the second thrust and the first thrust automatically becomes a thrust that hastens a hull behavior by the second thrust and, therefore, the vessel operator is able to perform a vessel operation that does not require finely tuned operation.

In a preferred embodiment of the present invention, the trolling motor includes a turning unit that changes a direction of a thrust with respect to the hull. The vessel operation system additionally includes a second operator that is operated by the vessel operator to maintain a heading or a position of the hull. The controller is configured or programmed to control the trolling motor so that the first thrust becomes a thrust of a magnitude and a direction to maintain the heading or the position of the hull in accordance with a command indicated by the second operator. If, in a state in which the trolling motor is generating the first thrust, there is a command indicated by the first operator, the controller is configured or programmed to control disable the command indicated by the second operator.

According to this structural arrangement, when the vessel operator operates the second operator, the first thrust of the trolling motor becomes a thrust of a magnitude and a direction to maintain the heading or the position of the hull and, therefore, the heading or the position of the hull is maintained by the first thrust. In this state, the vessel operator who desires to cancel maintaining the heading or the position of the hull and change a hull behavior mainly by the thrust of the propulsion apparatus should operate the first operator. When the vessel operator operates the first operator, a command indicated by the previous operation of the second operator is disabled and, therefore, the heading or the position of the hull will no longer be maintained by the first thrust of the trolling motor and the propulsion apparatus generates the second thrust. Thus, the influence that the first thrust has on a hull behavior is decreased, a hull behavior is automatically achieved mainly by the second thrust, and, therefore, the vessel operator is able to perform a vessel operation that does not require finely tuned operation.

In a preferred embodiment of the present invention, the propulsion apparatus is the only propulsion apparatus disposed on the hull. According to this structural arrangement, in a state in which a hull behavior is achieved by the first thrust of the trolling motor, the vessel operator who desires to achieve a hull behavior mainly by the thrust of the propulsion apparatus should operate the first operator. When the vessel operator operates the first operator, the only propulsion apparatus generates the second thrust and the first thrust of the trolling motor changes. If the influence that the first thrust has on a hull behavior decreases in accordance with the change of the first thrust, a hull behavior will automatically be achieved mainly by the second thrust and, therefore, the vessel operator is able to perform a vessel operation that does not require finely tuned operation.

In a preferred embodiment of the present invention, the propulsion apparatus is disposed at a stern of the hull and the trolling motor is mounted externally to a portion of the hull farther to a front of the hull than the propulsion apparatus. According to this structural arrangement, in a state in which a hull behavior is achieved by the first thrust of the trolling motor that is externally mounted to the portion of the hull farther to the front than the propulsion apparatus, the vessel operator who desires to achieve a hull behavior mainly by the thrust of the propulsion apparatus should operate the first operator. When the vessel operator operates the first operator, the propulsion apparatus generates the second thrust and the first thrust of the trolling motor changes. If the influence that the first thrust has on a hull behavior decreases in accordance with the change of the first thrust, a hull behavior will automatically be achieved mainly by the second thrust and, therefore, the vessel operator is able to perform a vessel operation that does not require finely tuned operation.

In a preferred embodiment of the present invention, the trolling motor is mounted externally to a bow of the hull. According to this structural arrangement, in a state in which a hull behavior is achieved by the first thrust of the trolling motor that is externally mounted to the bow of the hull, the vessel operator who desires to achieve a hull behavior mainly by the thrust of the propulsion apparatus should operate the first operator. When the vessel operator operates the first operator, the propulsion apparatus generates the second thrust and the first thrust of the trolling motor changes. If the influence that the first thrust has on a hull behavior decreases in accordance with the change of the first thrust, a hull behavior will automatically be achieved mainly by the second thrust and, therefore, the vessel operator is able to perform a vessel operation that does not require finely tuned operation.

According to a preferred embodiment of the present invention, a vessel includes a hull and the vessel operation system that is mounted on the hull. According to this structural arrangement, with the vessel, in a state in which a hull behavior is achieved by the first thrust of the trolling motor, the vessel operator who desires to achieve a hull behavior mainly by the thrust of the propulsion apparatus should operate the first operator. When the vessel operator operates the first operator, the propulsion apparatus generates the second thrust and the first thrust of the trolling motor changes. If an influence that the first thrust has on a hull behavior decreases in accordance with the change of the first thrust, a hull behavior will automatically be achieved mainly by the second thrust and, therefore, the vessel operator is able to perform a vessel operation that does not require finely tuned operation.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Preferred embodiments of the present invention will be hereinafter described in detail with reference to the accompanying drawings.

Figure 1:
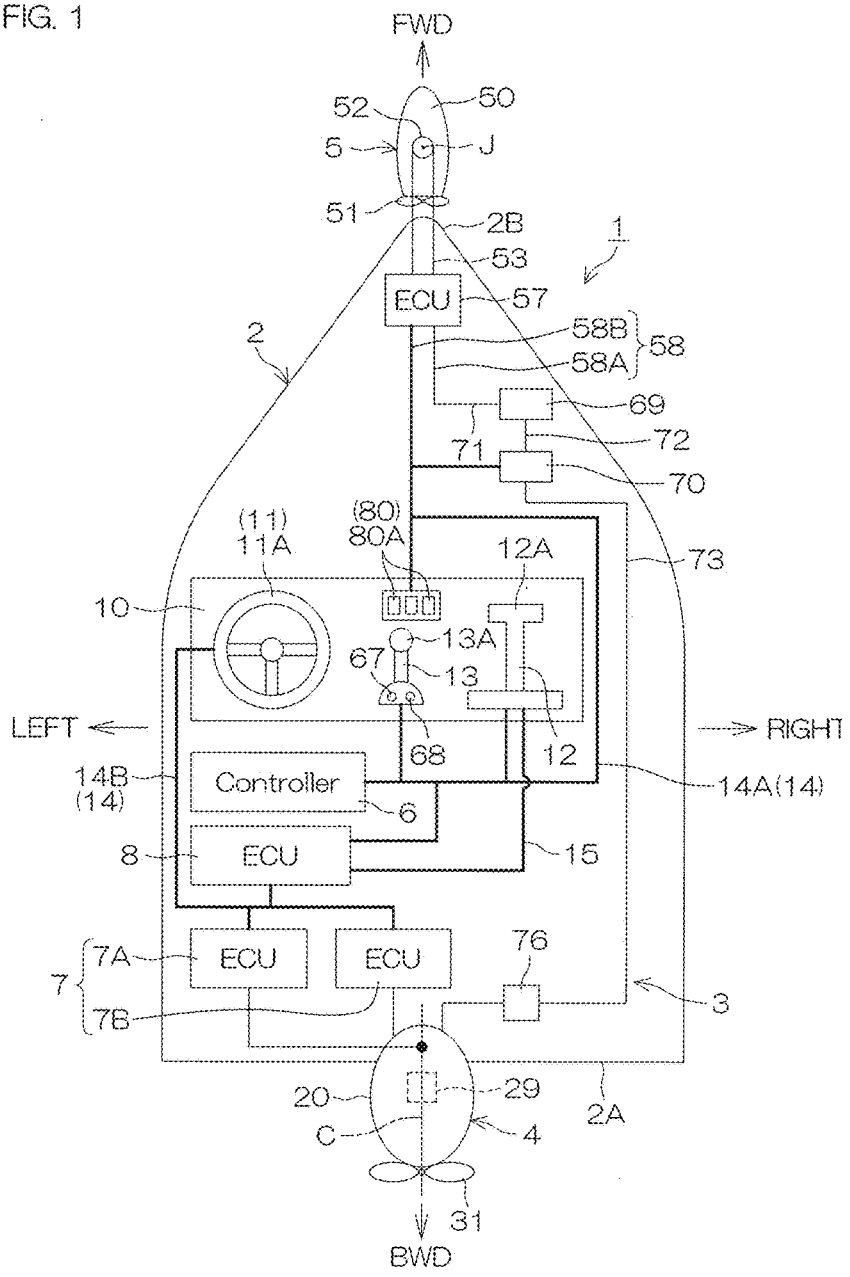
FIG. 1 is a conceptual diagram to describe an arrangement of a vessel according to a preferred embodiment of the present invention.

FIG. 1 is a conceptual diagram to describe an arrangement of a vessel 1 according to a preferred embodiment of the present invention. In the drawing, a forward direction (bow direction, or a direction from the stern toward the bow) of the vessel 1 is represented by an arrow FWD, and its backward direction (stern direction, or a direction from the bow toward the stern) is represented by an arrow BWD. Additionally, a right-hand side direction (starboard side direction) of the vessel 1 is represented by an arrow RIGHT, and its left-hand side direction (port side direction) is represented by an arrow LEFT. The vessel 1 in the present preferred embodiment is a small-sized or medium-sized fishing boat having, for example, a total length of approximately 25 feet at the maximum.

The vessel 1 includes a hull 2 and a vessel operation system 3 mounted on the hull 2. The vessel operation system 3 includes an outboard motor 4 that is an example of a propulsion apparatus, a trolling motor 5 that is provided independently of the outboard motor 4 and externally mounted to the hull 2, and a controller 6 that controls these components.

The vessel 1 is provided with only one outboard motor 4. In other words, the outboard motor 4 of the vessel 1 is the only propulsion apparatus provided on the hull 2 besides the trolling motor 5. The outboard motor 4 is a main propulsion apparatus in the vessel 1. The outboard motor 4 is designed to make a thrust act on the hull 2 at a more rearward position than a momentary rotational center P of the hull 2 (see FIG. 5, etc., described below). In the present preferred embodiment, the outboard motor 4 is disposed at a central portion in a right-left direction of a stern (transom) 2A of the hull 2. A center line C of the hull 2 passes through the central portion of the stern 2A and a bow 2B. An electronic control unit (hereinafter, referred to as "ECU") 7 is built into the outboard motor 4. It should be noted that, for convenience, the outboard motor 4 and the ECU 7 are shown separately from each other (the same applies to an ECU 57 to be described below) in FIG. 1. The ECU 7 in the present preferred embodiment is divided into an ECU 7A that mainly controls operation of an engine 29 (to be described below) built into the outboard motor 4 and an ECU 7B that is a steering control unit to control the outboard motor 4 in relation to a steering angle to be described below.

A vessel operation platform 10 for vessel operation is disposed at the vessel operation seat of the hull 2. The vessel operation platform 10 is provided with a steering operation portion 11 that is operated to perform steering, a throttle operation portion 12 that is operated to adjust an output of the outboard motor 4, and a joystick 13 that is operated to perform steering and to adjust the output of the outboard motor 4. The steering operation portion 11, the throttle operation portion 12, and the joystick 13 are each an example of a first operator that is operated by a vessel operator in order to indicate, to the controller 6, the ECU 7, etc., at least one of a magnitude and a direction of the thrust that the outboard motor 4 should apply to the hull 2. The first operator is included in the vessel operation system 3. For example, in the vessel operation platform 10, the steering operation portion 11 is located at a position closer to the left, the throttle operation portion 12 is located at a position closer to the right, and the joystick 13 is located between the steering operation portion 11 and the throttle operation portion 12. It is possible to arbitrarily change a layout of the steering operation portion 11, the throttle operation portion 12, and the joystick 13 in the vessel operation platform 10.

The steering operation portion 11 includes a steering handle 11A that is rotatable rightwardly and leftwardly. The throttle operation portion 12 includes a throttle lever 12A that is rotatable within a predetermined angular range in a front-rear direction. A tilt position of the throttle lever 12A when the throttle lever 12A is tilted forwardly from a neutral position by a predetermined angular amount is a forward shift-in position. A tilt position of the throttle lever 12A when the throttle lever 12A is tilted backwardly from the neutral position by a predetermined angular amount is a backward shift-in position. Although in the present preferred embodiment a head of the throttle lever 12A forms a substantially horizontal grip portion, a shape of the head can be changed arbitrarily.

The joystick 13 is a lever projecting from the vessel operation platform 10. The joystick 13 is tiltable freely in forward, backward, leftward, and rightward directions by operation of the vessel operator. The head of the joystick 13 is provided with a knob 13A that is able to be rotationally operated around an axis of the joystick 13. The entirety of the joystick 13, instead of the knob 13A, may be designed to be able to be rotationally operated around its axis.

The controller 6 is a BCU (basic control unit) that includes a microcomputer and is also called a navigation controller. The controller 6 communicates with the ECU 7 through a communication bus 14 disposed in the hull 2. More specifically, the vessel operation system 3 additionally includes another ECU 8 that relays between the controller 6 and the ECU 7. The communication bus 14 is configured, for example, by a CAN (control area network). The communication bus 14 includes a first communication bus 14A that connects the controller 6 and the ECU 8 and a second communication bus 14B that connects the ECU 7 and the ECU 8. The steering operation portion 11 is connected to the second communication bus 14B. Each of the throttle operation portion 12 and the joystick 13 is connected to the first communication bus 14A. The throttle operation portion 12 is locally connected to the ECU 8 through a wire or wireless communication line 15.

With the present preferred embodiment, it is possible to perform a vessel operation by using the steering operation portion 11 and the throttle operation portion 12 (hereinafter, referred to as the "steering vessel operation") and a vessel operation by using the joystick 13 (hereinafter, referred to as the "joystick vessel operation"). In the steering vessel operation, a signal that indicates an operational amount of the steering handle 11A and a signal that indicates an operational amount of the throttle lever 12A are input into the ECU 7. These signals include data indicating a target shift position (forward, neutral, or backward), a target throttle opening degree, and a target steering angle (hereinafter, referred to as the "target data"). In the joystick vessel operation, a signal that indicates a tilt amount of the joystick 13 and a rotational operation amount of the knob 13A is input into the controller 6. This signal includes the target data. The controller 6 provides the target data to the ECU 7.

Figure 2:
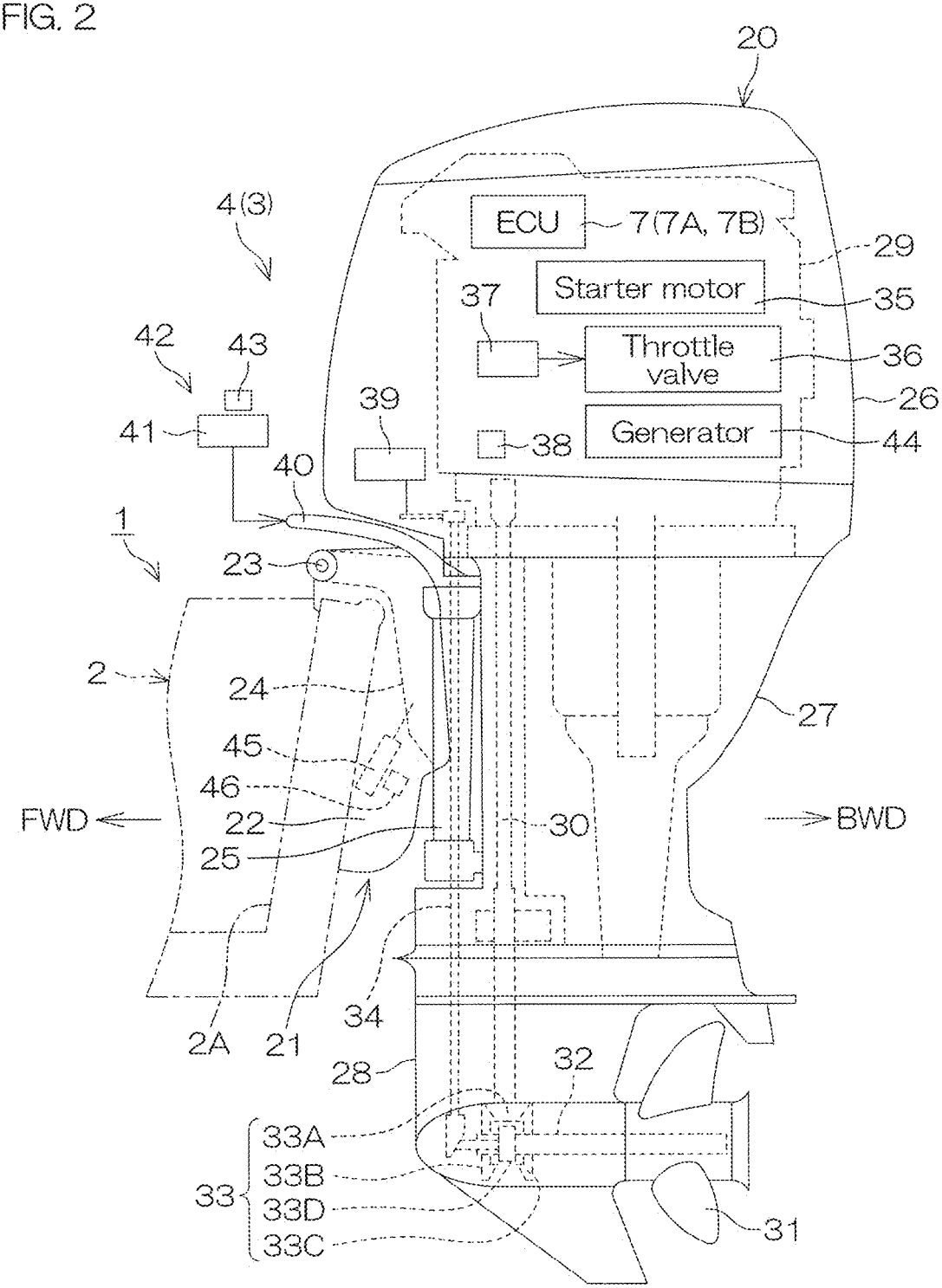
FIG. 2 is an illustrative cross-sectional view to describe an arrangement of a propulsion apparatus included in the vessel.

FIG. 2 is an illustrative cross-sectional view to describe an arrangement of the outboard motor 4. The outboard motor 4 includes a propulsion unit 20 that defines the main body of the outboard motor 4 and an attachment mechanism 21 to attach the propulsion unit 20 to the stern 2A. The attachment mechanism 21 includes a clamp bracket 22 that is detachably fixed to the stern 2A and a swivel bracket 24 that is joined to the clamp bracket 22 rotatably around a tilt shaft 23 that functions as a horizontal rotational shaft. The propulsion unit 20 is attached to the swivel bracket 24 rotatably around a steering shaft 25 that functions as a perpendicular rotational shaft. Thus, it is possible to change a steering angle by rotating the propulsion unit 20 around the steering shaft 25. The steering shaft 25 is located on the center line C of the hull 2 in a plan view. The steering angle is the direction of the thrust of the outboard motor 4 with respect to the center line C of the hull 2. Additionally, it is possible to change a trim angle of the propulsion unit 20 by rotating the swivel bracket 24 around the tilt shaft 23. The trim angle corresponds to the setting angle of the outboard motor 4 with respect to the hull 2.

A housing of the propulsion unit 20 includes a top cowling 26, an upper case 27, and a lower case 28. The engine 29 that functions as a driving source is installed in the top cowling 26 so that an axis of its crankshaft extends in an up-down direction. A drive shaft 30 for power transmission that is connected to a lower end of the crankshaft of the engine 29 extends through the inside of the upper case 27 in the up-down direction and extends to the inside of the lower case 28.

A propeller 31 that functions as a thrust-generating member is rotatably attached to the rear of a lower portion of the lower case 28. A propeller shaft 32 that is a rotational shaft of the propeller 31 extends in the horizontal direction in the lower case 28. The rotation of the drive shaft 30 is transmitted to the propeller shaft 32 through a shift mechanism 33 that functions as a clutch mechanism.

The shift mechanism 33 includes a driving gear 33A that is fixed to a lower end of the drive shaft 30, a forward gear 33B and a backward gear 33C that are rotatably located on the propeller shaft 32, and a dog clutch 33D located between the forward gear 33B and the backward gear 33C. The driving gear 33A, the forward gear 33B, and the backward gear 33C are each a bevel gear. The forward gear 33B is engaged with the driving gear 33A from the front, whereas the backward gear 33C is engaged with the driving gear 33A from the rear. Therefore, the forward gear 33B and the backward gear 33C are rotated in mutually opposite directions.

The dog clutch 33D is spline-coupled to the propeller shaft 32. More specifically, the dog clutch 33D is slidable with respect to the propeller shaft 32 in its axial direction, but the dog clutch 33D cannot make relative rotation with respect to the propeller shaft 32 and rotates together with the propeller shaft 32. The dog clutch 33D is slid on the propeller shaft 32 due to the rotation around an axis of a shift rod 34 extending in the up-down direction in parallel with the drive shaft 30. Thus, the dog clutch 33D is controlled in any shift position among a forward position in which it is coupled to the forward gear 33B, a backward position in which it is coupled to the backward gear 33C, and a neutral position in which it is coupled to neither the forward gear 33B nor the backward gear 33C.

When the dog clutch 33D is in the forward position, the rotation of the forward gear 33B is transmitted to the propeller shaft 32 through the dog clutch 33D. Thus, the propeller 31 rotates in one direction and generates a thrust in a direction (forward direction) in which the hull 2 is advanced forward. The rotation of the propeller 31 at this time is referred to as "normal rotation." On the other hand, when the dog clutch 33D is in the backward position, the rotation of the backward gear 33C is transmitted to the propeller shaft 32 through the dog clutch 33D. The backward gear 33C rotates in an opposite direction that is opposite to the rotational direction of the forward gear 33B, and therefore the propeller 31 rotates in the opposite direction, and generates a thrust in a direction (backward direction) in which the hull 2 is backwardly moved. The rotation of the propeller 31 at this time is referred to as "reverse rotation." When the dog clutch 33D is in the neutral position, the rotation of the drive shaft 30 is not transmitted to the propeller shaft 32. In other words, a driving-force transmission path between the engine 29 and the propeller 31 is shut off, and therefore a thrust in any direction is not generated.

With respect to the engine 29, a starter motor 35 is provided to start the engine 29. The starter motor 35 is controlled by the ECU 7A. A throttle actuator 37 is additionally provided to change an amount of intake air to the engine 29 by changing a throttle opening degree by actuating a throttle valve 36 of the engine 29. The throttle actuator 37 may include an electric motor. The operation of the throttle actuator 37 is controlled by the ECU 7A. The engine 29 is additionally provided with a throttle-opening-degree sensor 38 to detect and input a throttle opening degree into the ECU 7A.

With respect to the shift rod 34, a shift actuator 39 (clutch actuation device) is provided to rotate the shift rod 34 and change the shift position of the dog clutch 33D. The shift actuator 39 may include, for example, an electric motor, and its operation is controlled by the ECU 7A.

For example, a steering rod 40 that extends forwardly is fixed to the propulsion unit 20. A steering actuator 41 that is controlled by the ECU 7B is joined to the steering rod 40. The steering actuator 41 may have an arrangement including, for example, a DC servo motor and a decelerator. The steering actuator 41 is driven, and as a result, it is possible to rotate the propulsion unit 20 around the steering shaft 25, and it is possible to perform a steering operation. As described above, the steering actuator 41, the steering rod 40, and the steering shaft 25 define a turning unit 42 that changes a steering angle in the outboard motor 4. The turning unit 42 is provided with a steering angle sensor 43 to detect and input a steering angle into the ECU 7B. The steering angle sensor 43 may include, for example, a potentiometer.

The propulsion unit 20 additionally includes a generator 44 that is actuated by being linked to the rotation of the drive shaft 30, which is in turn actuated by the engine 29. The generator 44 is, for example, a motor and, in the present preferred embodiment, generates DC power when actuated. The propulsion unit 20 thus generates a thrust and electric power by the engine 29.

A trim actuator 45 that includes, for example, a hydraulic cylinder and that is controlled by the ECU 7 is located between the clamp bracket 22 and the swivel bracket 24. The trim actuator 45 rotates the propulsion unit 20 around the tilt shaft 23 by rotating the swivel bracket 24 around the tilt shaft 23. These components define a trim unit to change the trim angle of the propulsion unit 20. The trim angle is detected by a trim angle sensor 46. An output signal of the trim angle sensor 46 is input into the ECU 7.

Figure 3:
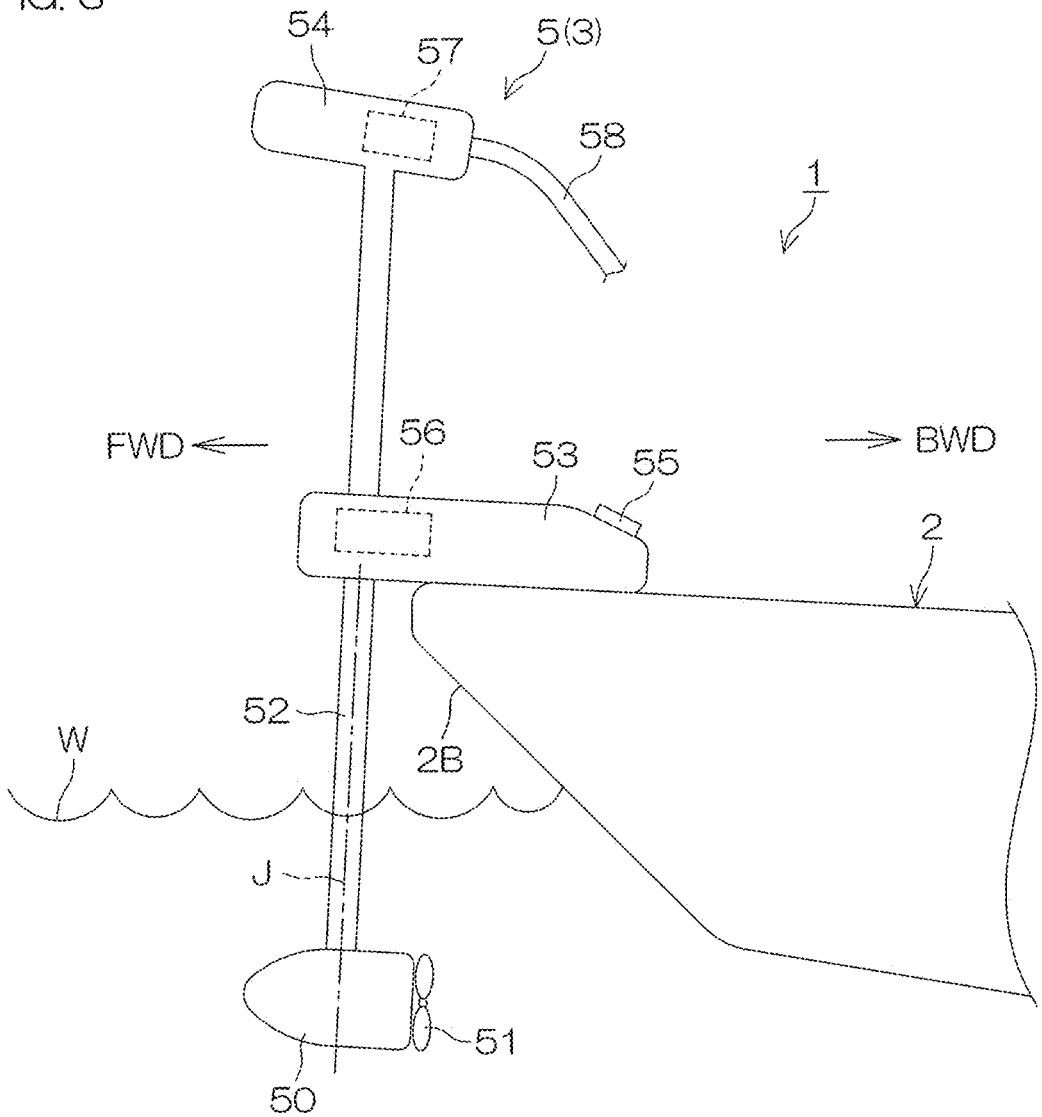
FIG. 3 is a schematic side view of a bow of the vessel.

FIG. 3 is a side view of a bow of the vessel 1. Unlike a bow thruster (not shown) that is incorporated in a bow of a hull during manufacture of a large-sized vessel, the trolling motor 5 is an aftermarket component that is retrofitted by being mounted externally to a finished vessel 1. The trolling motor 5 is a propulsion apparatus designed to apply to the hull 2 a thrust in an arbitrary direction around a rotational axis J that extends through the trolling motor 5 and extends in the up-down direction.

The trolling motor 5 in the present preferred embodiment is driven electrically. The trolling motor 5 includes an electric motor 50 that is PWM (pulse width modulation) controlled and a propeller 51 that generates a thrust by being rotationally driven by the electric motor 50. The propeller 51 may be attached to the electric motor 50 so as to be exposed from the electric motor 50 or may be built into the electric motor 50 like a so-called duct propeller.

The trolling motor 5 additionally includes a rotational shaft 52 that extends through the rotational axis J and extends upward from the electric motor 50 and a bracket 53 that is fixed to the bow 2B and supports the rotational shaft 52 rotatably around the rotational axis J. An upper portion of the rotational shaft 52 projects farther upward than the bracket 53. An operational panel 54 including an indicator (not shown) that indicates a direction of the propeller 51 underwater, etc., is provided at an upper end portion of the rotational shaft 52. A foot pedal or operator 55 (hereafter operation portion 55) that is operated by foot by the vessel operator to directly manipulate the trolling motor 5 is provided on an upper surface of the bracket 53.

The trolling motor 5 additionally includes an electrically-powered turning unit 56 that is, for example, built into the bracket 53 and rotates the rotational shaft 52 and the electric motor 50 around the rotational axis J, an ECU 57 that is, for example, built into the operational panel 54 and controls the electric motor 50 and the turning unit 56, and a harness 58 that is connected to the operational panel 54.

The turning unit 56 includes, for example, a servo motor. The turning unit 56 changes a direction of the thrust generated by the rotating propeller 51 by rotating the electric motor 50 around the rotational axis J to change a direction of the electric motor 50 within a range of 360 degrees. Thus, the direction of the thrust of the trolling motor 5 with respect to the center line C of the hull 2 (hereinafter, referred to as the "turning angle") changes. The harness 58 is connected to the ECU 57 inside the operational panel 54 and extends through the rotational shaft 52 to be connected to the electric motor 50 and the turning unit 56 as well.

The trolling motor 5 when being used is externally mounted to a portion of the hull 2 that is farther to the front than the outboard motor 4 so that the electric motor 50 and the propeller 51 are positioned lower than a water surface W. In the present preferred embodiment, the trolling motor 5 is externally mounted to the bow 2B of the hull 2. When the trolling motor 5 is not used, the electric motor 50 and the propeller 51 may be located above the water surface W, for example, by the rotational shaft 52 being tilted in the front-rear direction.

Figure 4:
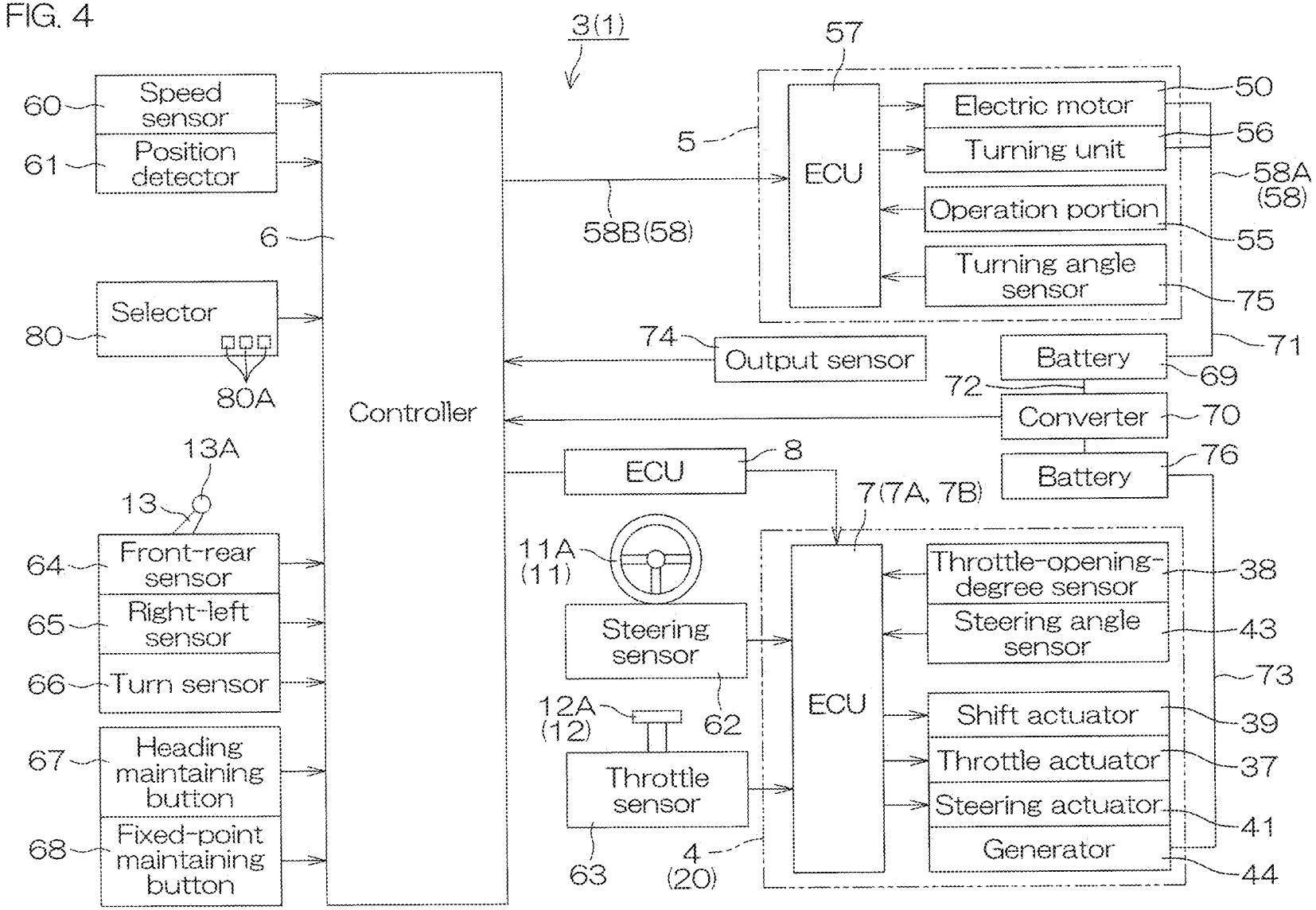
FIG. 4 is a block diagram showing an electrical configuration of the vessel.

FIG. 4 is a block diagram showing an electrical configuration of the vessel operation system 3. The vessel operation system 3 additionally includes a speed sensor 60 that detects and inputs the forward speed and the reverse speed of the vessel 1 into the controller 6 and a position detector 61 that generates and inputs a present-position signal of the vessel 1 into the controller 6. The speed sensor 60 may be a pitot tube, for example. The speed sensor 60 may be a device that detects a speed through the water or a device that detects a ground speed. The position detector 61 generates a present-position signal of the vessel 1, and may include, for example, a GPS receiver that receives radio waves from a GPS (Global Positioning System) satellite and that generates present-position information. The present-position signal may include information about the heading of the hull 2 (direction of the stern). The position detector 61 may be installed in the trolling motor 5.

The vessel operation system 3 additionally includes a steering sensor 62 that detects and inputs the rotational operation position of the steering handle 11A into the ECU 7. The vessel operation system 3 additionally includes a throttle sensor 63 that detects and inputs a tilt amount in the front-rear direction of the throttle lever 12A into the ECU 7. The steering sensor 62 and the throttle sensor 63 may each include a potentiometer.

The vessel operation system 3 additionally includes a front-rear sensor 64 that detects and inputs the tilt position of the joystick 13 in the front-rear direction into the controller 6 and a right-left sensor 65 that detects and inputs the tilt amount of the joystick 13 in the right-left direction into the controller 6. The vessel operation system 3 additionally includes a turn sensor 66 that detects and inputs the operation position (rotational operation direction and rotational operation amount) of the knob 13A into the controller 6. The front-rear sensor 64, the right-left sensor 65, and the turn sensor 66 may each include a potentiometer.

The vessel operation system 3 additionally includes a heading maintaining button 67 that is operated by the vessel operator pressing the heading maintaining button 67 in order to maintain the heading of the hull 2 while preventing the veering of the hull 2, and a fixed-point maintaining button 68 that is operated by the vessel operator pressing the fixed-point maintaining button 68 in order to maintain the position of the hull 2 at a present position. The heading maintaining button 67 and the fixed-point maintaining button 68 are each an example of a second operator that is operated by the vessel operator to instruct the controller 6 to maintain the heading or the position of the hull 2. The heading maintaining button 67 and the fixed-point maintaining button 68 are provided, for example, on or at the joystick 13 (see FIG. 1). When the heading maintaining button 67 is operated, a signal to maintain a heading is input into the controller 6. When the fixed-point maintaining button 68 is operated, a signal to maintain a position of the hull 2 is input into the controller 6.

The vessel operation system 3 additionally includes a battery 69 that is installed in the hull 2 and supplies electric power to the trolling motor 5 and a converter 70 that converts the electric power generated by the generator 44 of the outboard motor 4 to electric power to charge the battery 69. The battery 69 includes, for example, two batteries (rated output: 12 V) that are connected in series. The battery 69 is charged by the electric power generated by the outboard motor 4. A power supply line 58A that is included in the harness 58 of the trolling motor 5 is connected to the battery 69 directly or through a cable 71. The trolling motor 5 generates a thrust by being driven by the electric power from the battery 69. More specifically, in the trolling motor 5, the electric motor 50 rotates the propeller 51 by receiving the power supply from the battery 69 and decreases a rotation speed of the propeller 51 by the power supply from the battery 69 being shut off. In the trolling motor 5, the turning unit 56 is actuated by receiving electric power from the battery 69. An indicator (not shown) that indicates a remaining amount of the electric power of the battery 69 may be provided on the vessel operation platform 10 or the operational panel 54 of the trolling motor 5.

The battery 69 and the converter 70 are connected through a cable 72. The converter 70 and the generator 44 are connected through a cable 73. The converter 70 in the present preferred embodiment is a DC-DC converter that boosts the DC power generated by the generator 44. The converter 70 is also connected to the first communication bus 14A (see FIG. 1). The vessel operation system 3 additionally includes an output sensor 74 that detects and inputs an output (power consumption, etc.) of the trolling motor 5 into the controller 6. Another battery 76 (rated output: 12 V) is provided in the middle of the cable 73. The battery 76 supplies electric power to the outboard motor 4.

A signal line 58B that is included in the harness 58 is connected to the controller 6 directly or through the communication bus 14. The controller 6 provides commands related to PWM control of the electric motor 50 and commands related to operation details of the turning unit 56 (rotation direction and rotation angle of the electric motor 50 around the rotational axis J) to the ECU 57 of the trolling motor 5. The commands related to PWM control of the electric motor 50 include a command value concerning the output of the trolling motor 5 and this command value is input into the trolling motor 5. At the trolling motor 5 into which the command value has been input, the ECU 57 controls the electric motor 50 by PWM control so as to generate a thrust that is in accordance with the command value. The vessel operation system 3 additionally includes a turning angle sensor 75 that detects and inputs the rotation angle of the electric motor 50, that is, the above-described turning angle into the ECU 57. The turning angle sensor 75 may include, for example, a potentiometer.

The controller 6 includes a microcomputer including a processor (CPU) and a memory, and at the controller 6, various functions are achieved by the processor executing calculations and controls in accordance with a program stored in the memory. The controller 6 operates as a plurality of functional processors. These functional processors include a target-value setter that sets a target value of the thrust to act on the hull 2 and a thrust allocator that calculates individual target values concerning a thrust to be generated by each of the outboard motors 4 and by the trolling motor 5 in accordance with the target value set by the target-value setter. The target-value setter and the thrust allocator may be integrated as one functional processor. The plurality of functional processors may be consolidated in the controller 6 or may be distributed among the controller 6 and the ECU 8. That is, the ECU 8 may be regarded as a portion of the controller 6. The ECU 7 and the ECU 57 may also be regarded as portions of the controller 6.

The movement of each component of the vessel 1 that is caused by a vessel operation will be hereinafter described. In the vessel 1, it is possible to activate the outboard motor 4 in a state in which the trolling motor 5 has been stopped and to perform a vessel operation that uses only the thrust of the outboard motor 4. When only the thrust of the outboard motor 4 is used, it is possible to perform a steering vessel operation that uses the steering operation portion 11 and the throttle operation portion 12 or perform a joystick vessel operation that uses the joystick 13. When the vessel operator operates any of the steering handle 11A, the throttle lever 12A, and the joystick 13, a vessel-operation request issued by the vessel operator is input into the controller 6 or the ECU 7 of the outboard motor 4.

In the steering vessel operation, the vessel-operation request is input into the ECU 7. The ECU 7 into which the vessel-operation request has been input sets the target steering angle in accordance with a handle steering angle (rotational operation amount and rotation direction) of the steering handle 11A that is detected by the steering sensor 62. More specifically, with respect to the rotational operation of the steering handle 11A in the rightward direction from the neutral position, the ECU 7B of the ECU 7 sets the target steering angle for right-handed rotation. Likewise, with respect to the rotational operation of the steering handle 11A in the leftward direction from the neutral position, the ECU 7B sets the target steering angle for left-handed rotation. In any case, the target steering angle is set so that its absolute value (deflection angle from the neutral position) becomes larger in proportion to an increase in the rotational operation amount of the steering handle 11A from the neutral position. The ECU 7B controls the steering actuator 41 so that the steering angle detected by the steering angle sensor 43 coincides with the target steering angle.

The ECU 7 into which the vessel-operation request has been input sets the target shift position and the target throttle opening degree for the outboard motor 4 in accordance with the tilt amount of the throttle lever 12A detected by the throttle sensor 63. More specifically, if a forward tilt amount of the throttle lever 12A is equal to or more than a value corresponding to the forward shift-in position, the ECU 7A sets the target shift position of the outboard motor 4 as the forward position. If the throttle lever 12A goes beyond the forward shift-in position and is further tilted forwardly, the ECU 7A sets a larger target throttle opening degree in proportion to an increase in its tilt amount. Likewise, if a rearward tilt amount of the throttle lever 12A is equal to or more than a value corresponding to the backward shift-in position, the ECU 7A sets the target shift position of the outboard motor 4 as the backward position. If the throttle lever 12A goes beyond the backward shift-in position and is further tilted rearwardly, the ECU 7A sets a larger target throttle opening degree in proportion to an increase in its tilt amount.

When the tilt position of the throttle lever 12A is between the forward shift-in position and the backward shift-in position, the ECU 7A sets the target shift position of the outboard motor 4 as the neutral position. At this time, the driving force of the engine 29 is not transmitted to the propeller 31, and therefore a thrust from the outboard motor 4 is not generated. In other words, an operating range between the forward shift-in position and the backward shift-in position is a dead zone that does not result in the generation of a thrust.

When the target shift position and the target throttle opening degree are set in this way, the ECU 7A controls the shift actuator 39 so that the dog clutch 33D is located at the target shift position. The ECU 7A controls the throttle actuator 37 so that the throttle opening degree detected by the throttle-opening-degree sensor 38 coincides with the target throttle opening degree.

In the joystick vessel operation, the controller 6 into which the vessel-operation request has been input generates the target shift position and the target throttle opening degree of the outboard motor 4 in accordance with the operation in the front-rear direction of the joystick 13 performed by the vessel operator. Additionally, the controller 6 generates the target steering angle of the outboard motor 4 in accordance with the rotational operation of the knob 13A performed by the vessel operator. As another operation example, the controller 6 may generate the target steering angle in accordance with the operation in the right-left direction of the joystick 13 while the controller 6 sets the target shift position and the target throttle opening degree in accordance with the operation in the front-rear direction of the joystick 13.

Specifically, the controller 6 generates the target shift position and the target throttle opening degree in accordance with the tilt amount in the front-rear direction of the joystick 13. More specifically, if the forward tilt amount of the joystick 13 is equal to or more than a value corresponding to the forward shift-in position, the controller 6 sets the target shift position as the forward position. When the joystick 13 goes beyond the forward shift-in position and is further tilted forwardly, the controller 6 sets a larger target throttle opening degree in proportion to an increase in its tilt amount. Likewise, if a rearward tilt amount of the joystick 13 is equal to or more than a value corresponding to the backward shift-in position, the controller 6 sets the target shift position as the backward position. When the joystick 13 goes beyond the backward shift-in position and is further tilted rearwardly, the controller 6 sets a larger target throttle opening degree in proportion to an increase in its tilt amount. When the tilt position in the front-rear direction of the joystick 13 is between the forward shift-in position and the backward shift-in position, the controller 6 sets the target shift position as the neutral position.

The controller 6 sets the target steering angle in accordance with the rotational operation amount and the rotation direction of the knob 13A. More specifically, with respect to the rotational operation in the rightward direction of the knob 13A, the target steering angle for right-handed rotation is set, and its absolute value (deflection angle from the neutral position) becomes larger in proportion to an increase in the rotational operation amount from the neutral position. Likewise, with respect to the rotational operation in the leftward direction of the knob 13A, the target steering angle for left-handed rotation is set, and its absolute value becomes larger in proportion to an increase in the rotational operation amount from the neutral position.

When a rightward/leftward tilt of the joystick 13 is used to set the target steering angle, the controller 6 sets the target steering angle for right-handed rotation with respect to the tilt operation in the rightward direction of the joystick 13. Likewise, the controller 6 sets the target steering angle for left-handed rotation with respect to the tilt operation in the leftward direction of the joystick 13. In any case, the target steering angle is set so that its absolute value (deflection angle from the neutral position) becomes larger in proportion to an increase in the tilt amount from the neutral position of the joystick 13.

The controller 6 provides the target values (target shift position, target throttle opening degree, and target steering angle) to the ECU 7 of the outboard motor 4. The ECU 7A controls the shift actuator 39 so that the dog clutch 33D is located at the target shift position. The ECU 7A controls the throttle actuator 37 so that the throttle opening degree detected by the throttle-opening-degree sensor 38 coincides with the target throttle opening degree. The ECU 7B controls the steering actuator 41 so that the steering angle detected by the steering angle sensor 43 coincides with the target steering angle.

With the vessel 1, it is possible to perform not only a vessel operation only by the outboard motor 4 (hereinafter, referred to as the "first sole vessel operation") but also a vessel operation only by the trolling motor 5 (hereinafter, referred to as the "second sole vessel operation"). For example, the vessel operator who has arrived at a fishing site and has temporarily stopped the vessel 1 stands on the bow 2B and operates the operation portion 55 of the trolling motor 5 with a foot to finely adjust the heading and position of the vessel 1. Then, at the trolling motor 5, the ECU 57 controls the electric motor 50 and the turning unit 56 so that the thrust of the magnitude and direction that are in accordance with the operation of the operation portion 55 by the vessel operator is generated. Thus, the vessel 1 undergoes low speed movement by the second sole vessel operation to a point of the fishing site desired by the vessel operator. At this time, the outboard motor 4 may be in an idling state without stopping and the dog clutch 33D may be at the neutral position.

The operation portion 55 may be a detachable remote controller and if so, the vessel operator is able to perform remote operation of the trolling motor 5 by the operation portion 55 in a state of staying in a vicinity of the vessel operation platform 10. Additionally, the vessel operator is also able to perform remote operation of the trolling motor 5 not by the operation portion 55 but by operating the joystick 13. A description will be hereinafter given of an operation of the trolling motor 5 by the joystick 13.

With the vessel 1, it is also possible to perform a vessel operation by cooperation between the outboard motor 4 and the trolling motor 5 (hereinafter, referred to as the "cooperative vessel operation"). In the present preferred embodiment, the joystick 13 is used in the cooperative vessel operation. In other words, in the present preferred embodiment, the cooperative vessel operation is an example of the joystick vessel operation described above. As a matter of course, the steering handle 11A and the throttle operation portion 12 may be used instead of the joystick 13. The vessel operation system 3 additionally includes a selector 80 to switch a vessel operation mode to any of the first sole vessel operation, the second sole vessel operation, and the cooperative vessel operation. The selector 80 includes switches 80A corresponding to the respective vessel operation modes and is connected to the first communication bus 14A (see FIG. 1). The controller 6 operates in each vessel operation mode in accordance with a combination of a driving state of the engine 29 of the outboard motor 4 and an operation state of the switches 80A.

As one example, the controller 6 switches the vessel operation mode from the second sole vessel operation to the cooperative vessel operation. In this case, the controller 6 sets the target values of the thrusts of the outboard motor 4 and the trolling motor 5 in accordance with the operation of the joystick 13, that is, a command indicated by the joystick 13. The controller 6 achieves the switching of the vessel operation mode by controlling each propulsion apparatus (specifically, the ECU of each propulsion apparatus) so as to generate an individual target thrust (that may at times be zero).

Figure 5:
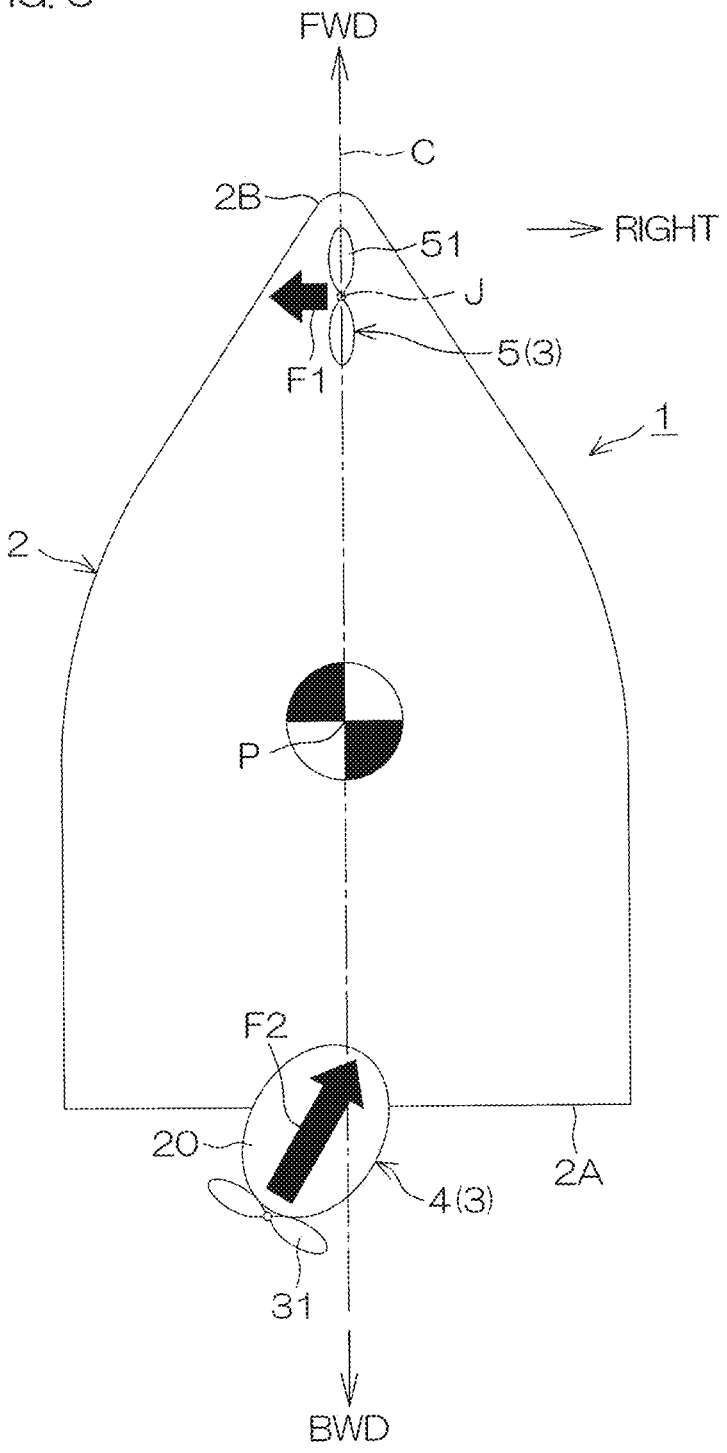
FIG. 5 is a view to describe a behavior of the vessel by a vessel operation according to a first example of a preferred embodiment of the present invention.

FIG. 5 is a schematic view to describe a behavior of the vessel 1 by a vessel operation according to a first example. The steering angle of the outboard motor 4 is the deflection angle of a rotational axis of the propeller 31 of the outboard motor 4 with respect to the center line C of the hull 2, and a direction from the bow 2B toward the stern 2A is set as 0 degrees, and, with respect to this direction, a right-handed rotational direction (counterclockwise direction) is set as positive, whereas a left-handed rotational direction (clockwise direction) is set as negative. The rotational axis of the propeller 31 coincides with a line of action of the thrust generated by the outboard motor 4 in a plan view. The turning angle of the trolling motor 5 may also be defined in a manner similar to the steering angle, and a rotational axis of the propeller 51 of the trolling motor 5 coincides with a line of action of the thrust generated by the trolling motor 5 in a plan view.

When the vessel operator who has arrived at a desired point of a fishing site operates the heading maintaining button 67 or the fixed-point maintaining button 68 to perform fishing at that point, a maintain command in accordance with the operation is input into the controller 6. In accordance with the input of this command, the controller 6 calculates a target value of a thrust to maintain the position or heading of the hull 2.

More specifically, based on the present-position signal of the vessel 1 generated by the position detector 61, the controller 6 calculates a momentary amount of change of the position of the vessel 1, and, from this amount of change, the controller 6 calculates waves or the like and an external force applied by the waves or the like acting on the vessel 1. Thereafter, the controller 6 calculates a target value of a thrust of magnitude and direction that balances the calculated external force. Thereafter, the controller 6 controls and drives the trolling motor 5 so as to generate a thrust based on this target value. The vessel operation mode in this state is the second sole vessel operation, and by the thrust generated by the trolling motor 5 (hereinafter, referred to as the "first thrust F1") becoming the target value, the heading or the position of the hull 2 is maintained in a state in which veering and drifting of the hull 2 are significantly reduced or prevented.

When the vessel operator operates the heading maintaining button 67 or the fixed-point maintaining button 68 again, a discontinue order that indicates discontinuation of maintaining the heading or the fixed-point is input into the controller 6. When the discontinue order is input, the controller 6 stops the trolling motor 5, and input of a subsequent command is awaited.

At a popular point of a fishing site, a large number of vessels gather together and therefore, another vessel may approach the vessel 1 that is maintaining the heading or position. If in this case, the vessel operator of the vessel 1 that is maintaining the heading or position wishes to avoid another vessel that is approaching, the vessel operator is able to operate the joystick 13 in a direction desired to avoid the other vessel. When a command is indicated by operation of the joystick 13 in a state in which the trolling motor 5 is generating the first thrust F1 to maintain the heading or position of the hull 2, the controller 6 disables the previous command indicated by the heading maintaining button 67 or the fixed-point maintaining button 68.

The controller 6 that disabled the command indicated by the heading maintaining button 67 or the fixed-point maintaining button 68 switches the vessel operation mode to the cooperative vessel operation. In accordance with the switching of the vessel operation mode, the controller 6 sets and provides a target value that is in accordance with the operation of the joystick 13 to the ECU 7 of the outboard motor 4. The ECU 7 controls the shift actuator 39, the throttle actuator 37, and the steering actuator 41 of the outboard motor 4 as described above to make the outboard motor 4 generate a thrust that is in accordance with the target value (hereinafter, referred to as a "second thrust F2").

Thereafter, the controller 6 controls the trolling motor 5 so that the first thrust F1 changes from its prior state (thrust in the second sole vessel operation) and differs from the second thrust F2. More specifically, the controller 6 controls the trolling motor 5 so that a magnitude of the first thrust F1 differs from a magnitude of the second thrust F2 or controls the trolling motor 5 so that a direction of the first thrust F1 differs from a direction of the second thrust F2. The controller 6 may control the trolling motor 5 so that the magnitude and the direction of the first thrust F1 differ respectively from the magnitude and the direction of the second thrust F2.

To control the trolling motor 5 so that the first thrust F1 changes, the controller 6 may decrease the first thrust F1 or may stop the trolling motor 5 and make the first thrust F1 zero. Or, the controller 6 may control the trolling motor 5 so that the first thrust F1 becomes a thrust that hastens or more quickly brings about a behavior of the hull 2 due to the second thrust F2. In this case, in FIG. 5, the controller 6 makes the trolling motor 5 generate the first thrust F1 that is leftward so as to hasten a left-handed rotation of the hull 2 by the second thrust F2.

As described above, according to a preferred embodiment of the present invention, in a state in which the trolling motor 5 is generating the first thrust F1, the controller 6 controls the outboard motor 4 so that it generates the second thrust F2 in accordance with a command indicated by the joystick 13 or other first operator. In this process, the controller 6 controls the trolling motor 5 so that the first thrust F1 changes from its prior state.

According to this structural arrangement, in a state in which a behavior of the hull 2 is achieved by the first thrust F1 of the trolling motor 5, the vessel operator who desires to achieve a behavior of the hull 2 mainly by the thrust of the outboard motor 4 should operate the first operator. When the vessel operator operates the first operator, the outboard motor 4 generates the second thrust F2 and the first thrust F1 of the trolling motor 5 changes so as to differ from the second thrust F2. When the first operator is thus operated, the outboard motor 4 and the trolling motor 5 are controlled integrally in response to its command and, therefore, a vessel operation skill demanding expertise so as to adjust the first thrust F1 of the trolling motor 5 and the second thrust F2 of the outboard motor 4 individually is not required of the vessel operator. And if an influence that the first thrust F1 has on a behavior of the hull 2 decreases in accordance with the change of the first thrust F1, a behavior of the hull 2 will automatically be achieved mainly by the second thrust F2 and, therefore, the vessel operator is able to perform a vessel operation that does not require finely tuned operation.

Particularly, with the vessel 1, vessel operation interfaces for the outboard motor 4 and the trolling motor 5 are unified as the first operator. In this case, the vessel operator, when desiring to avoid another vessel that is approaching as described above, is relieved of an operation of stopping the trolling motor 5 by operating the operation portion 55 of the trolling motor 5 and thereafter switching to the first operation portion to move the outboard motor 4. In other words, the vessel operator is able to achieve intuitive vessel operation without switching the vessel operation interface and it is therefore possible to achieve improved operability by the vessel operator. The operation portion 55 itself does not have to be present.

In a preferred embodiment of the present invention, in a state in which the trolling motor 5 is generating the first thrust F1, the controller 6 controls the outboard motor 4 so as to generate the second thrust F2 in accordance with a command indicated by the first operator. Additionally, the controller 6 controls the trolling motor 5 so that the magnitude of the first thrust F1 differs from the magnitude of the second thrust F2.

According to this structural arrangement, in a state in which a behavior of the hull 2 is achieved by the first thrust F1 of the trolling motor 5, the vessel operator who desires to achieve a behavior of the hull 2 mainly by the thrust of the outboard motor 4 should operate the first operator. When the vessel operator operates the first operator, the outboard motor 4 generates the second thrust F2 and the magnitude of the first thrust F1 of the trolling motor 5 changes so as to differ from the magnitude of the second thrust F2. If the influence that the first thrust F1 has on a behavior of the hull 2 decreases in accordance with the change in the magnitude of the first thrust F1, a behavior of the hull 2 will automatically be achieved mainly by the second thrust F2 and, therefore, the vessel operator is able to perform a vessel operation that does not require finely tuned operation.

In a preferred embodiment of the present invention, in a state in which the trolling motor 5 is generating the first thrust F1, the controller 6 controls the outboard motor 4 so as to generate the second thrust F2 in accordance with a command indicated by the first operator. Additionally, the controller 6 controls the trolling motor 5 so that the direction of the first thrust F1 differs from the direction of the second thrust F2.

According to this structural arrangement, in a state in which a behavior of the hull 2 is achieved by the first thrust F1 of the trolling motor 5, the vessel operator who desires to achieve a behavior of the hull 2 mainly by the thrust of the outboard motor 4 should operate the first operator. When the vessel operator operates the first operator, the outboard motor 4 generates the second thrust F2 and the direction of the first thrust F1 of the trolling motor 5 changes so as to differ from the direction of the second thrust F2. If the influence that the first thrust F1 has on a behavior of the hull 2 decreases in accordance with the change in the direction of the first thrust F1, a behavior of the hull 2 will automatically be achieved mainly by the second thrust F2 and therefore, the vessel operator is able to perform a vessel operation that does not require finely tuned operation.

In a preferred embodiment of the present invention, in a state in which the trolling motor 5 is generating the first thrust F1, the controller 6 controls the trolling motor 5 so that the first thrust F1 decreases in accordance with a command indicated by the first operator.

According to this structural arrangement, when the vessel operator who desires to change a behavior of the hull 2 from being achieved by the first thrust F1 of the trolling motor 5 to being achieved mainly by the thrust of the outboard motor 4 operates the first operator, the outboard motor 4 generates the second thrust F2 and the first thrust F1 decreases. The influence that the first thrust F1 has on a behavior of the hull 2 decreases in accordance with the decrease in the first thrust F1. Thus, a behavior of the hull 2 is automatically achieved mainly by the second thrust F2 and, therefore, the vessel operator is able to perform a vessel operation that does not require finely tuned operation.

As described above, in a state in which the trolling motor 5 is generating the first thrust F1, the controller 6 may automatically stop the trolling motor 5 in accordance with a command indicated by the first operator.

According to this structural arrangement, when the vessel operator who desires to change a behavior of the hull 2 from being achieved by the first thrust F1 of the trolling motor 5 to being achieved mainly by the thrust of the outboard motor 4 operates the first operator, the outboard motor 4 generates the second thrust F2 and the trolling motor 5 stops. The first thrust F1 becomes zero in accordance with the stoppage of the trolling motor 5 and, therefore, the influence that the first thrust F1 has on a behavior of the hull 2 disappears. Thus, a behavior of the hull 2 is automatically achieved by the second thrust F2 and, therefore, the vessel operator is able to perform a vessel operation that does not require finely tuned operation.

In a preferred embodiment of the present invention, the controller 6 controls the outboard motor 4 so as to generate the second thrust F2 in accordance with a command indicated by the first operator. Additionally, the controller 6 may control the trolling motor 5 so that the first thrust becomes a thrust that hastens a behavior of the hull 2 by the second thrust F2.

According to this structural arrangement, the vessel operator who desires to change a behavior of the hull 2 from being achieved by the first thrust F1 of the trolling motor 5 to being achieved mainly by the thrust of the outboard motor 4 should operate the first operator. When the vessel operator operates the first operator, the outboard motor 4 generates the second thrust F2 and the first thrust F1 automatically becomes a thrust that hastens a behavior of the hull 2 by the second thrust F2 and, therefore, the vessel operator is able to perform a vessel operation that does not require finely tuned operation.

In a preferred embodiment of the present invention, when the vessel operator operates the heading maintaining button 67 or the fixed-point maintaining button 68, the first thrust F1 of the trolling motor 5 becomes a thrust of a magnitude and a direction to maintain the heading or the position of the hull 2. Thus, the heading or the position of the hull 2 is maintained by the first thrust F1. In this state, the vessel operator who desires to cancel maintaining the heading or the position of the hull 2 and achieve a behavior of the hull 2 mainly by the thrust of the outboard motor 4 should operate the first operator. When the vessel operator operates the first operator, a command indicated by the previous operation of the heading maintaining button 67 or the fixed-point maintaining button 68 is disabled and, therefore, the heading or the position of the hull 2 will no longer be maintained by the first thrust F1 of the trolling motor 5 and the outboard motor 4 generates the second thrust F2. Thus, the influence that the first thrust F1 has on a behavior of the hull 2 is decreased, a behavior of the hull 2 is automatically achieved mainly by the second thrust F2, and, therefore, the vessel operator is able to perform a vessel operation that does not require finely tuned operation. It may also be made possible for the vessel operator to operate both the heading maintaining button 67 and the fixed-point maintaining button 68 to maintain both the heading and the position of the hull 2.

In a preferred embodiment of the present invention, the outboard motor 4 is the only propulsion apparatus that is disposed on the hull 2 and is provided at the stern 2A of the hull 2, and the trolling motor 5 is mounted externally to the portion of the hull 2 farther to the front than the outboard motor 4 (specifically, at the bow 2B). According to this structural arrangement, in a state in which a behavior of the hull 2 is achieved by the first thrust F1 of the trolling motor 5, the vessel operator who desires to achieve a behavior of the hull 2 mainly by the thrust of the outboard motor 4 should operate the first operator. When the vessel operator operates the first operator, the outboard motor 4 generates the second thrust F2 and the first thrust F1 of the trolling motor 5 changes. If the influence that the first thrust F1 has on a behavior of the hull 2 decreases in accordance with the change of the first thrust F1, a behavior of the hull 2 will automatically be achieved mainly by the second thrust F2 and, therefore, the vessel operator is able to perform a vessel operation that does not require finely tuned operation.

Although preferred embodiments of the present invention have been described above, the present invention is not restricted to the contents of these preferred embodiments and various modifications are possible within the scope of the present invention.

For example, with the vessel 1 that is of a type provided with only one outboard motor 4 (a so-called single motor vessel), the thrust of the outboard motor 4 cannot be made to act only leftwardly or only rightwardly with respect to the hull 2, and therefore the hull 2 cannot be made to undergo a rightward or leftward translational movement by only the thrust of the outboard motor 4. "Translational movement" is a rectilinear movement that is not accompanied by turning around the rotational center P of the hull 2. Although a small-sized or medium-sized single motor vessel is an introductory model in many cases, for translational movement, adequate vessel operation skill is necessary and expertise is demanded of the vessel operator.

Figure 6:
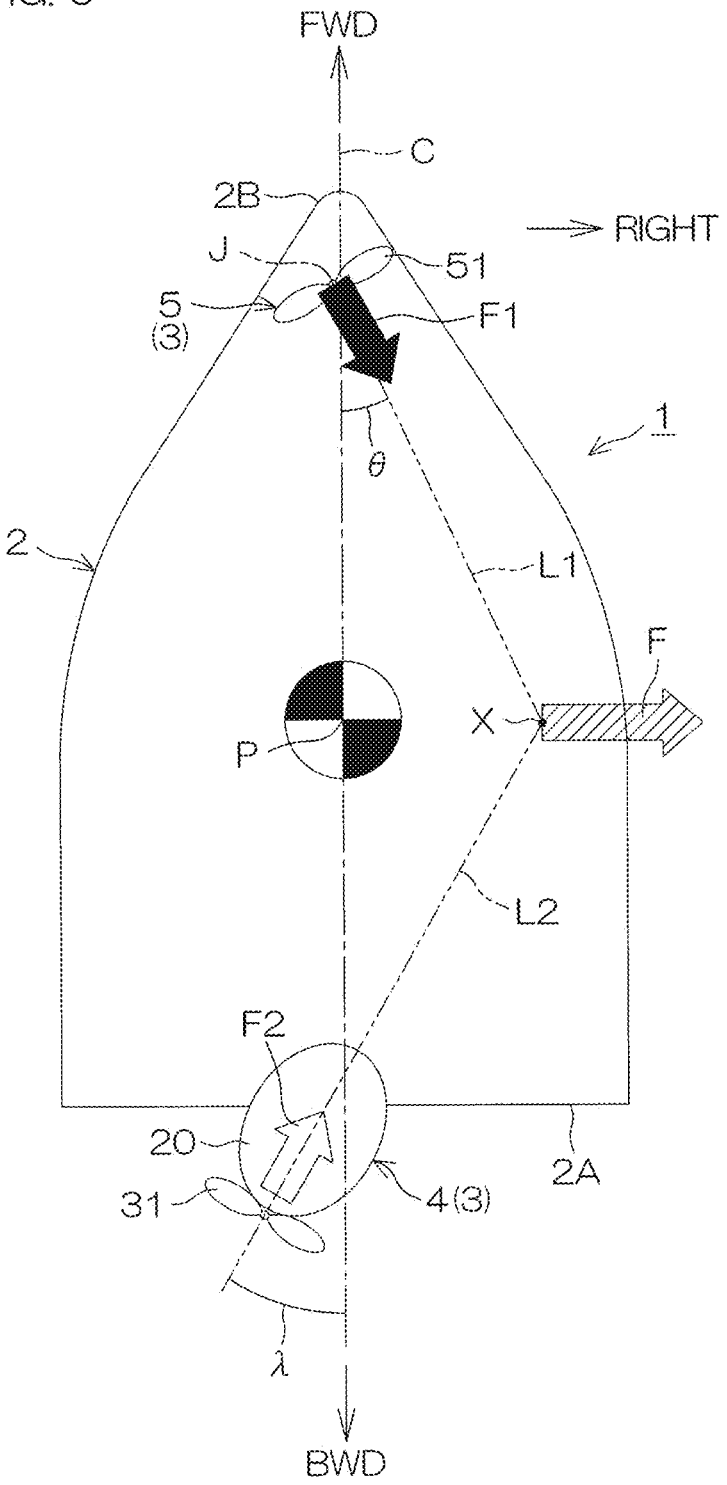
FIG. 6 is a view to describe a behavior of the vessel by a vessel operation according to a second example of a preferred embodiment of the present invention.

However, with the vessel 1, it is possible to make the hull 2 to undergo a rightward or leftward translational movement by the cooperative vessel operation by the outboard motor 4 and the trolling motor 5. A description will be hereinafter given of a vessel operation according to a second example for making the hull 2 of the vessel 1 undergo, for example, a rightward translational movement. FIG. 6 is a view to describe a behavior of the vessel 1 by the vessel operation according to the second example.

For example, when the vessel operator tilts the joystick 13 to the right to perform berthing, a signal that indicates a rightward tilt amount of the joystick 13 detected by the right-left sensor 65 is input into the controller 6 as a translational movement command. At this time, the controller 6 calculates a target value concerning a thrust to be applied to the hull 2. More specifically, the hull 2 is able to undergo a rightward translational movement at a speed desired by the vessel operator if a rightward thrust F that is in accordance with the tilt amount of the joystick 13 acts on the hull 2. For this, a resultant force of the second thrust F2 of the outboard motor 4 and the first thrust F1 of the trolling motor 5 is required to become the thrust F. Additionally, the magnitudes of the first thrust F1 and the second thrust F2 must be set so that a yawing moment (hereinafter, referred to as "moment") around the rotational center P due to the second thrust F2 and a moment around the rotational center P due to the first thrust F1 cancel each other out.

The controller 6 sets a target value of the thrust F in accordance with the tilt amount of the joystick 13. Thereafter, the controller 6 calculates respective target values of the first thrust F1 and the second thrust F2 that are required to make the thrust F become the target value based on the maximum thrust of the trolling motor 5, etc. More specifically, the controller 6 calculates target values of the first thrust F1 and a turning angle θ for the trolling motor 5 and calculates respective target values of the second thrust F2 and a steering angle A for the outboard motor 4. Subsequent processes are performed in the same way as described above.

To make the hull 2 undergo a rightward translational movement, the controller 6 changes the turning angle θ and the steering angle A so that a crossing position X of a line of action L1 of the first thrust F1 and a line of action L2 of the second thrust F2 coincides with the rotational center P in the front-rear direction and is positioned farther to the right than the rotational center P. More specifically, the controller 6 makes the propulsion unit 20 of the outboard motor 4 rotate leftward so that the respective absolute values of the turning angle θ and the steering angle A become equal to each other, and makes the propeller 51 of the trolling motor 5 rotate in a clockwise direction or in a counter-clockwise direction in a plan view. Thereafter, the controller 6 makes the outboard motor 4 generate the second thrust F2 in the forward direction and makes the trolling motor 5 generate the first thrust F1 in the backward direction.

Thus, the resultant force of the first thrust F1 and the second thrust F2 becomes the rightward thrust F and acts on the hull 2. By this thrust vectoring, the hull 2 undergoes the rightward translational movement at the speed desired by the vessel operator operating the joystick 13.

Although, in regard to the translational movement of the hull 2, a rightward translational movement has been described, this lateral movement is merely one example, and the cooperative vessel operation is applicable to translational movements in all directions including a right-left direction component, such as a diagonal movement, etc. As a matter of course, the cooperative vessel operation is also applicable to movements (for example, turning during ordinary traveling) other than the translational movement.

Instead of being an outboard motor of an engine type including the engine 29 that is an internal combustion engine, the outboard motor 4 may be an electrically-driven outboard motor that rotates the propeller 31 by an electric motor in place of the engine 29. Also, a plurality of the outboard motors 4 may be provided and mounted on the stern 2A in a state of being aligned in the right-left direction. Also, the trolling motor 5 may be of an engine type instead of being of an electrically-driven type.

An inboard/outboard motor or a waterjet drive may be used instead of the outboard motor 4 as an example of the propulsion apparatus. In the inboard/outboard motor, a prime mover is located inside the vessel, and a drive unit that includes a thrust generating member and a steering mechanism is located outside the vessel. An inboard motor includes both a prime mover and a drive unit built into the hull and in which a propeller shaft extends from the drive unit toward the outside of the vessel. In this case, the steering mechanism is separately provided. The waterjet drive obtains a thrust by accelerating water sucked from the vessel bottom by use of a pump and by jetting the water from a jet nozzle at the stern. In this case, the steering mechanism includes a jet nozzle and a mechanism that rotates the jet nozzle along a horizontal plane.

The various features described above may be appropriately combined together.

Also, features of two or more of the various preferred embodiments described above may be combined.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A vessel operation system comprising:

a propulsion apparatus disposed on a hull;

a trolling motor mounted externally to the hull;

an operator operable by a vessel operator to directly manipulate the trolling motor;

a first operator operable by the vessel operator in order to indicate at least one of a magnitude and a direction of a thrust that the propulsion apparatus is to apply to the hull; and a controller configured or programmed to, in a state in which the trolling motor is generating a first thrust in accordance with an operation of the operator and the propulsion apparatus is not generating thrust, in accordance with a command indicated by the first operator, control the propulsion apparatus so as to generate a second thrust and control the trolling motor so that the first thrust changes.

2. The vessel operation system according to claim 1, wherein, in a state in which the trolling motor is generating the first thrust in accordance with the operation of the operator and the propulsion apparatus is not generating thrust, in accordance with the command indicated by the first operator, the controller is configured or programmed to control the propulsion apparatus so as to generate the second thrust and control the trolling motor so that a magnitude of the first thrust differs from a magnitude of the second thrust.

3. The vessel operation system according to claim 1, wherein, in a state in which the trolling motor is generating the first thrust in accordance with the operation of the operator and the propulsion apparatus is not generating thrust, in accordance with the command indicated by the first operator, the controller is configured or programmed to control the propulsion apparatus so as to generate the second thrust and control the trolling motor so that a direction of the first thrust differs from a direction of the second thrust.

4. The vessel operation system according to claim 1, wherein, in a state in which the trolling motor is generating the first thrust in accordance with the operation of the operator and the propulsion apparatus is not generating thrust, the controller is configured or programmed to control the trolling motor so that the first thrust decreases in accordance with the command indicated by the first operator.

5. The vessel operation system according to claim 1, wherein, in a state in which the trolling motor is generating the first thrust in accordance with the operation of the operator and the propulsion apparatus is not generating thrust, the controller is configured or programmed to stop the trolling motor in accordance with the command indicated by the first operator.

6. The vessel operation system according to claim 1, wherein, in accordance with the command indicated by the first operator, the controller is configured or programmed to control the propulsion apparatus so as to generate the second thrust and control the trolling motor so that the first thrust becomes a thrust that hastens a behavior of the hull by the second thrust.

7. The vessel operation system according to claim 4, wherein the trolling motor includes a turning unit that changes a direction of a thrust with respect to the hull;

the vessel operation system further comprises a second operator operated by the vessel operator to maintain a heading or a position of the hull;

the controller, in accordance with a command indicated by the second operator, is configured or programmed to control the trolling motor so that the first thrust becomes a thrust of a magnitude and a direction to maintain the heading or the position of the hull; and when, in a state in which the trolling motor is generating the first thrust in accordance with the command indicated by the second operator, there is a command indicated by the first operator, the controller is configured or programmed to disable the command indicated by the second operator.

8. The vessel operation system according to claim 1, wherein the propulsion apparatus is the only propulsion apparatus disposed on the hull.

9. The vessel operation system according to claim 1, wherein the propulsion apparatus is disposed at a stern of the hull; and the trolling motor is mounted externally to a portion of the hull farther toward a front of the hull than the propulsion apparatus.

10. The vessel operation system according to claim 9, wherein the trolling motor is mounted externally to a bow of the hull.

11. A vessel comprising:

a hull; and the vessel operation system according to claim 1 mounted on the hull.

* * * * *